US010329822B2

(12) United States Patent
Berchowitz

(10) Patent No.: US 10,329,822 B2
(45) Date of Patent: Jun. 25, 2019

(54) DOOR LATCH WITH OPENING AND CLOSING MECHANICAL ADVANTAGE

(71) Applicant: Global Cooling, Inc., Athens, OH (US)

(72) Inventor: David M. Berchowitz, Athens, OH (US)

(73) Assignee: Global Cooling, Inc., Athens, OH (US)

( * ) Notice: Subject to any disclaimer, the term of this patent is extended or adjusted under 35 U.S.C. 154(b) by 514 days.

(21) Appl. No.: 15/089,810

(22) Filed: Apr. 4, 2016

(65) Prior Publication Data

US 2017/0284143 A1 Oct. 5, 2017

(51) Int. Cl.

| | |
|---|---|
| ***E05F 11/54*** | (2006.01) |
| ***E05C 3/14*** | (2006.01) |
| ***E05B 65/00*** | (2006.01) |
| ***E05C 3/04*** | (2006.01) |
| ***E05B 13/10*** | (2006.01) |
| ***E05B 15/00*** | (2006.01) |
| *E05B 17/00* | (2006.01) |
| *F25D 23/02* | (2006.01) |

(52) U.S. Cl.

CPC ..... *E05F 11/54* (2013.01); *E05B 13/10* (2013.01); *E05B 15/0086* (2013.01); *E05B 65/0042* (2013.01); *E05C 3/046* (2013.01); *E05C 3/14* (2013.01); *E05B 17/0025* (2013.01); *E05Y 2900/306* (2013.01); *F25D 23/028* (2013.01)

(58) Field of Classification Search

CPC ..... Y10T 292/1047; Y10S 292/71; E05B 65/0046; E05B 65/0042

See application file for complete search history.

(56) References Cited

U.S. PATENT DOCUMENTS

| | | | | |
|---|---|---|---|---|
| 2,777,722 A * | 1/1957 | Burke | E05B 65/0046 292/332 |
| 2,833,578 A * | 5/1958 | Burke | E05C 19/024 292/216 |
| 2,901,277 A * | 8/1959 | Anderson | E05C 19/024 292/78 |
| 3,344,462 A | 10/1967 | Webster | |
| 3,506,292 A * | 4/1970 | Hagendoorn | E05C 19/024 292/216 |

(Continued)

FOREIGN PATENT DOCUMENTS

| | | |
|---|---|---|
| CN | 200520014081 | 1/2007 |
| CN | 201020295480 | 2/2011 |

*Primary Examiner* — Mark A Williams

(74) *Attorney, Agent, or Firm* — Frank H. Foster; Kremblas & Foster

(57) ABSTRACT

A door latch which provides leverage to the door in both the closing and opening operations of the latch's door handle. The door latch has a door axle attached to an edge of the door and a striker is attached to the cabinet. A latch pivoting component has a base bearing journaled to the door axle and a handle attached to the base bearing for manually rotating the base bearing about the door axle. A cam is attached to the base bearing and is engageable with the striker by rotation of the base bearing. The cam includes a closing cam segment and an opening cam segment. The opening cam segment engages and slides along the striker as the latch pivoting component is rotated in an opening direction of rotation. The closing cam segment engages and slides along the striker as the latch pivoting component is rotated in a closing direction of rotation.

11 Claims, 7 Drawing Sheets

(56) References Cited

U.S. PATENT DOCUMENTS

| | | | | |
|---|---|---|---|---|
| 3,593,547 | A * | 7/1971 | Taylor | E05C 3/047 292/108 |
| 5,553,820 | A | 9/1996 | Karten et al. | |
| D454,050 | S | 3/2002 | Kelly et al. | |
| 6,457,675 | B1 * | 10/2002 | Plude | B64C 1/1415 244/129.5 |
| 6,543,820 | B2 | 4/2003 | Kelly | |
| 7,090,263 | B2 | 8/2006 | Quigley et al. | |
| 2005/0194795 | A1 | 9/2005 | Hapke et al. | |
| 2009/0102204 | A1 * | 4/2009 | Hilliard | E05B 1/0053 292/139 |
| 2014/0284946 | A1 | 9/2014 | Bennett et al. | |

* cited by examiner

Fig. 1
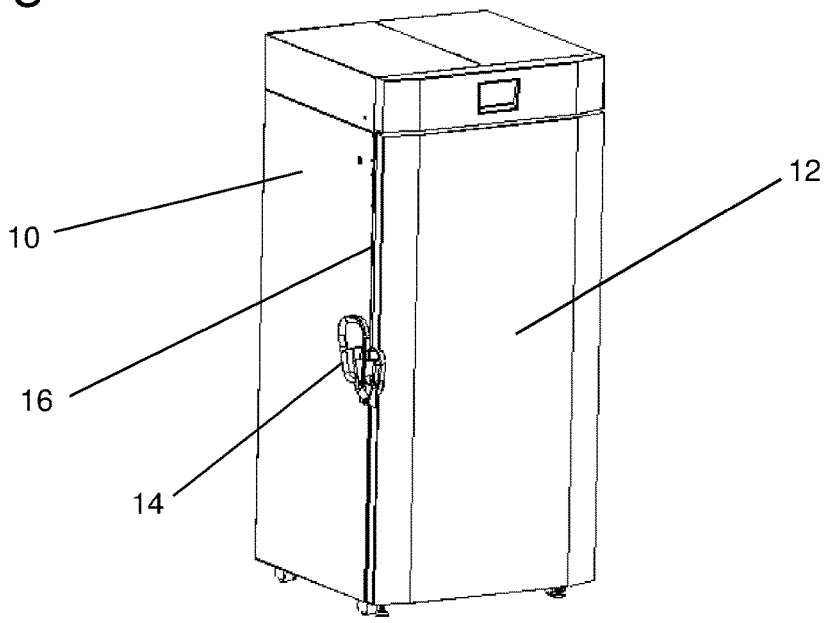
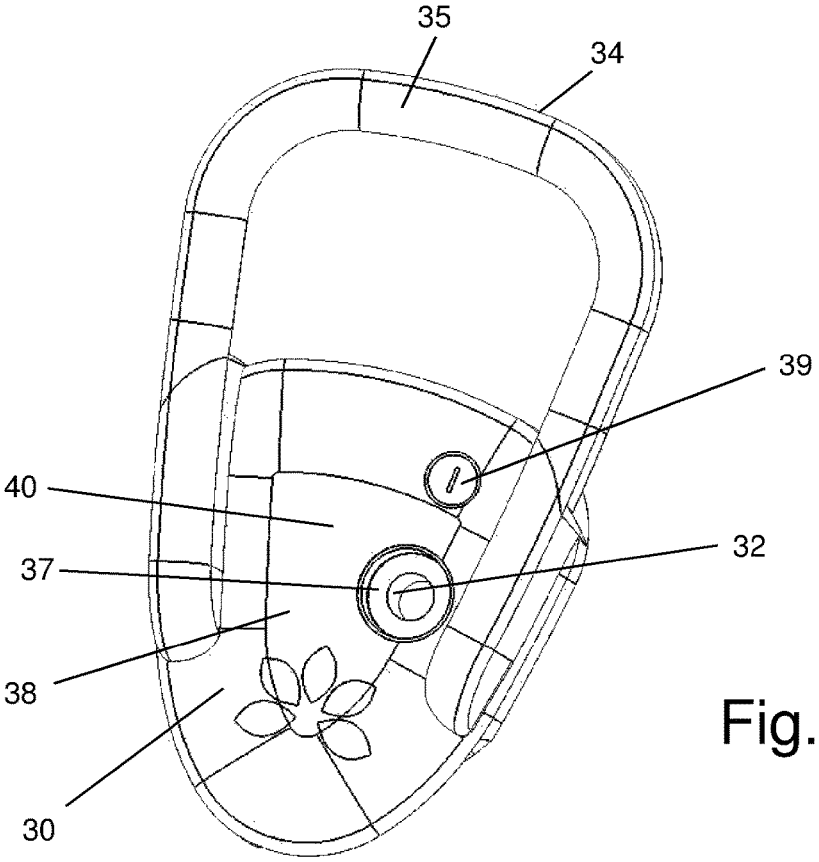
Fig. 2

Fig. 3
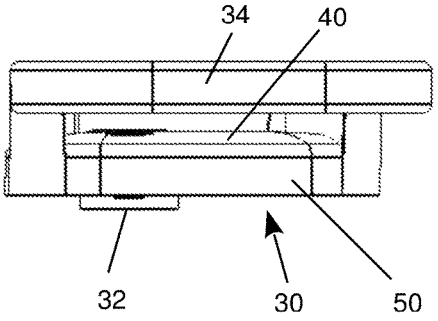
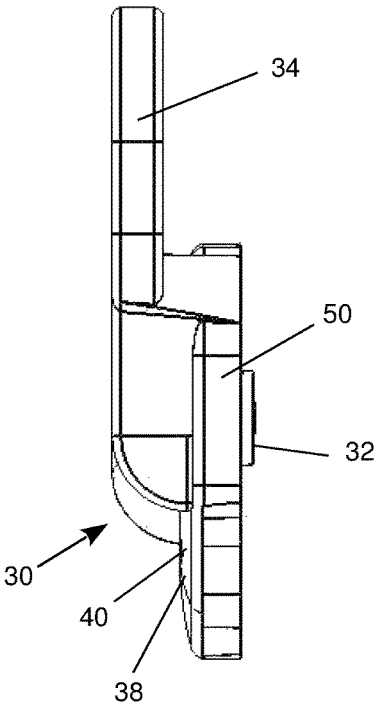
Fig. 4
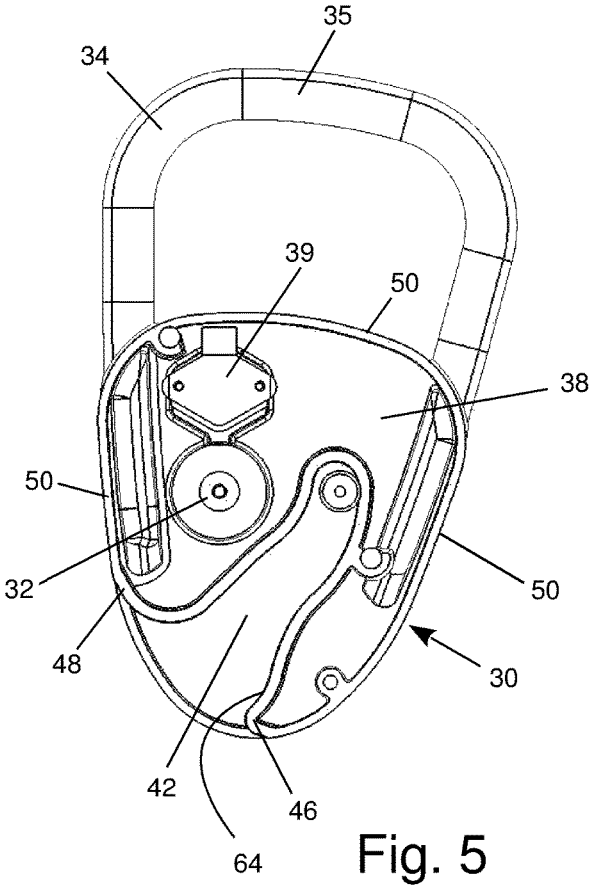
Fig. 5

Fig. 6
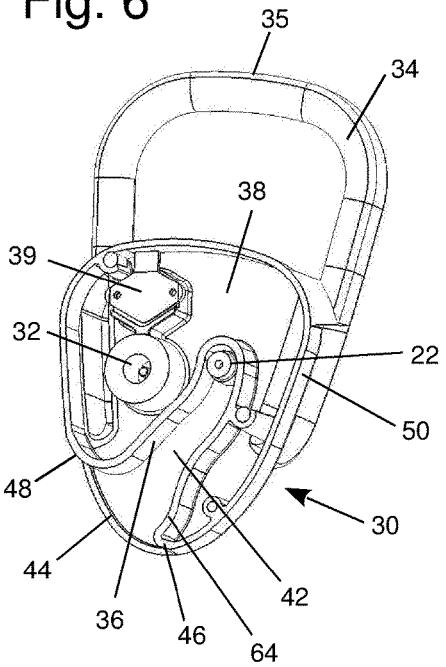
Fig. 7
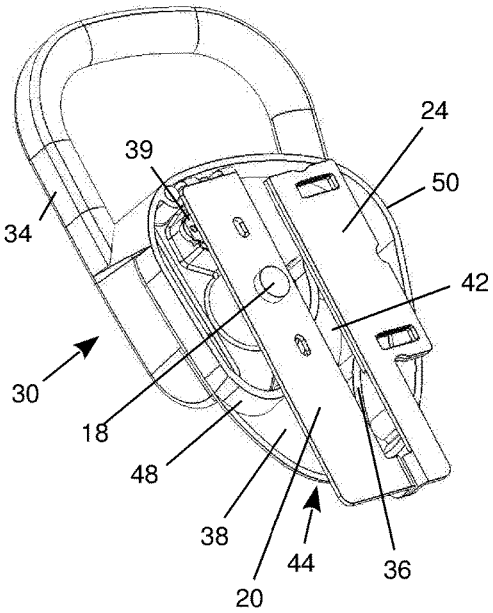
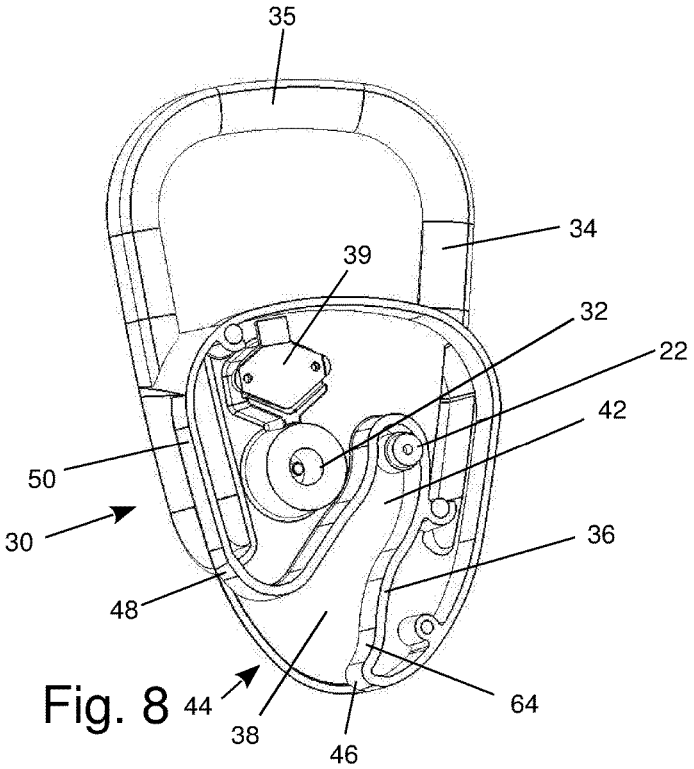
Fig. 8

Fig. 10
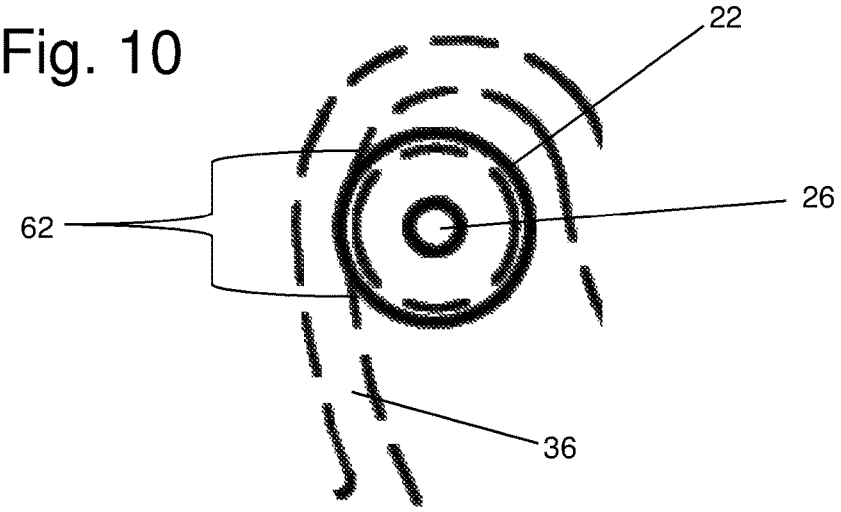
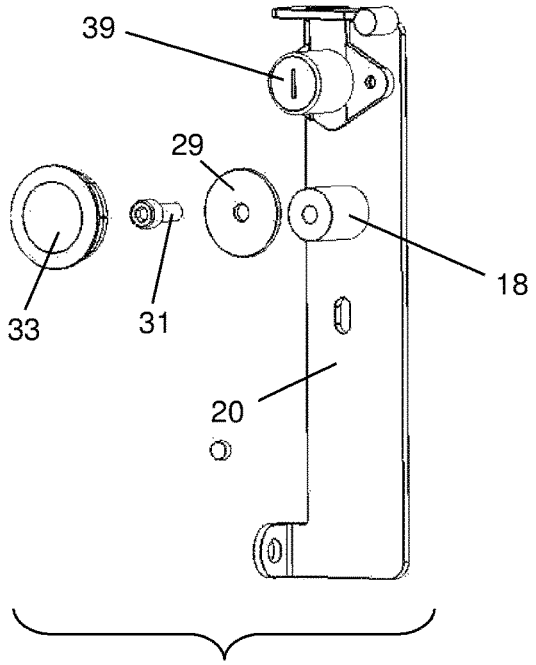
Fig. 11
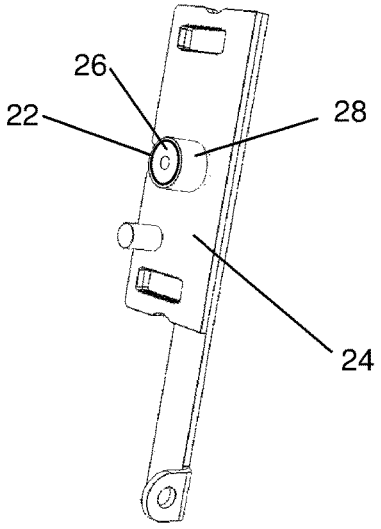
Fig. 12

DOOR LATCH WITH OPENING AND CLOSING MECHANICAL ADVANTAGE

BACKGROUND OF THE INVENTION

This invention generally relates to a simple door latch which provides leverage to the door in both the closing and opening operations of the latch's door handle which is particularly desirable for ultra-low temperature (ULT) freezers. The latching handle of the invention, when rotated by a user, applies a closing force to compress a door gasket and an opening force to unseat a frozen gasket or some other resisting force. Doors that have frozen onto their gaskets and therefore make the door difficult to open are a particular problem associated with ULT Freezers.

ULT freezers generally operate at temperatures from −70° C. to below −145° C. The door gasket seal may account for 30% or more of the heat leak into the cabinet. Proper compression of the gasket seal is imperative to obtain a seal that exhibits good thermal resistance to the relatively warm ambient air. It is desirable that this be accomplished by a latch that requires an operating effort no more than can be offered by a person of minimum strength. This implies that the door latch should not require the application of a substantial force against the door in order to get the latch engaged and that the door be closable and latchable by a one hand operation.

When a ULT freezer cabinet door is opened, ambient moisture tends to condense onto the door gasket and the cabinet's thermal breaker assembly. Under certain conditions, when the door is subsequently closed, the condensed moisture will freeze and bond the door gasket to the frame of the cabinet and thus require a large force to break the bond and re-open the door. In the prior art, heating has been provided in the door frame either electrically or by a warm refrigerant line. This works most of the time but occasionally doors become frozen to the door frame and therefore require applying an external opening force of substantial magnitude often through application of a prying bar.

A similar problem arises when the door needs to be opened shortly after being closed. In this situation, the ambient air that entered the freezer when the door was open becomes cold. The reduced air temperature in the freezer cabinet reduces the pressure within the cabinet causing a force of considerable magnitude across the door that tends to hold the door closed. A vacuum breaker is generally provided to ameliorate this problem of differential pressure. However, the equalization of pressure afforded by the vacuum breaker takes a little time, perhaps up to 10 minutes. Anyone who needs access to a recently opened and closed freezer must therefore wait until the internal pressure has been equalized with the ambient pressure. It would be of great utility if a simple door latch were provided to assist in opening the door in cases where it is frozen shut or is held closed by differential pressure or both.

During closing, the door gasket must be properly compressed to obtain good thermal resistance to the ambient air. The compression force applied by the gasket against the door is large and therefore substantial leverage is needed to allow a person of minimum strength to apply the necessary force. This leveraged force should also be reversible in order to more easily open the door in the event that the door is adhered to the gasket by condensed water that has frozen or in the event that the internal cabinet pressure has dropped to a low level thereby creating a large force that resists opening.

Another desirable feature of a latch for a ULT freezer is that the freezer door latch can be moved by a simple single handed operation to unlatch and pull open the door and similarly to push closed and latch the door. The reason is that commonly a user has an object in one hand when opening or closing the freezer door such as a container of vials to be placed in or just removed from the freezer.

It is therefore an object and purpose of the invention to provide a door latching mechanism that applies a sufficient gasket compression force without requiring more effort than can be provided by one handed operation of a person of minimum strength and also can be leveraged open by the same one handed effort as is available from such a person.

BRIEF SUMMARY OF THE INVENTION

The latch of the invention not only latches or releases the cabinet door but also acts as a lever to apply a force with a mechanical advantage for both opening and closing the door. That mechanical advantage changes as a function of the rotational angle of the latch handle in order to change the door closing or opening force applied by a user who is opening or closing the door and in order to change the rate at which the door is pushed open or closed. The latch is designed so that the force applied as a result of the mechanical advantage and the rate of change of the mechanical advantage both vary as the latch handle is rotated. They vary to values that are desirable for the changing position of the door with respect to the cabinet as the door is being opened or closed.

The door latch has a door axle attached to an edge of the door for pivotally mounting a latch pivoting component. A striker is attached to the cabinet in a juxtaposition with the door axle that permits the pivoting component to be rotated into and out of engagement with the striker. The latch pivoting component has a base bearing journaled to the door axle and a handle is attached to the base bearing for manually rotating the base bearing about the door axle. A cam is attached to the base bearing and is engageable with the striker by rotation of the base bearing. The cam has a cam surface defining a striker harbor with a peripherally outwardly opening mouth for receiving the striker into the striker harbor. The striker harbor extends from the striker harbor mouth progressively closer to the base bearing. The cam surface includes a closing cam surface on a side of the striker harbor and an opening cam surface on the opposite side of the striker harbor. The opening cam surface is positioned a radial distance from the base bearing to engage and slide along the striker as the latch pivoting component is rotated in an opening direction of rotation. The closing cam surface is positioned a radial distance from the base bearing to engage and slide along the striker as the latch pivoting component is rotated in a closing direction of rotation.

BRIEF DESCRIPTION OF THE SEVERAL VIEWS OF THE DRAWINGS

FIG. 1 is a view in perspective of an ultra-low temperature freezer to which is mounted a latch embodying the invention.

FIG. 2 is a view in frontal perspective of the latch pivoting component of the invention.

FIG. 3 is a top view of the latch pivoting component.

FIG. 4 is a side view of the latch pivoting component.

FIG. 5 is a rear view of the latch pivoting component.

FIG. 6 is a rear perspective view of the latch pivoting component with the striker also shown.

FIG. 7 is a rear perspective view of the latch.

FIG. 8 is a rear perspective view of the latch pivoting component from a different perspective.

FIG. 10 is a greatly enlarged view of a segment of the latch illustrating the striker seated against the retaining cam segment of the cam.

FIG. 11 is a view in exploded perspective of the door axle and the door axle attachment bracket of the latch.

FIG. 12 is a view in perspective of the striker and the striker attachment bracket of the latch.

Figure 9:
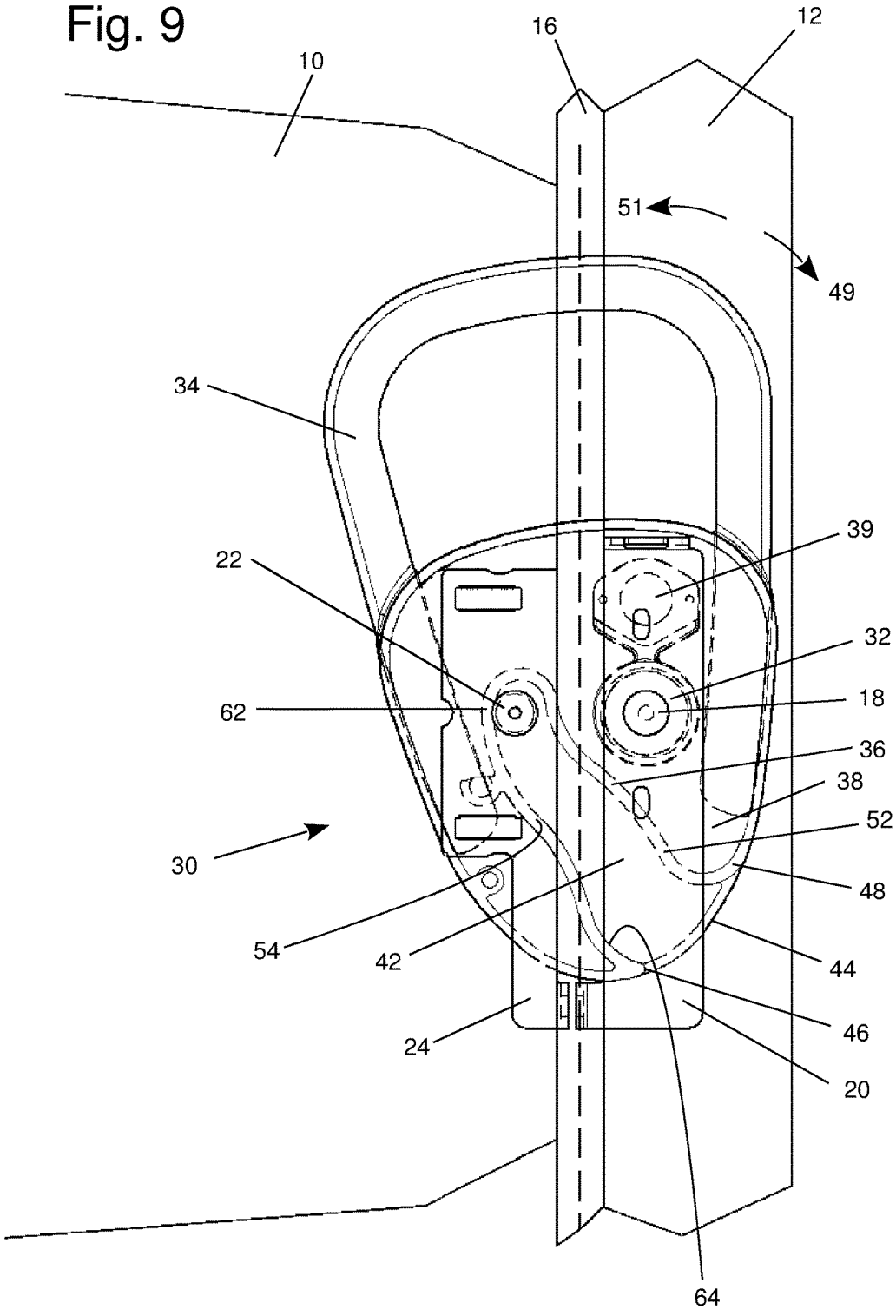
FIG. 9 is a front view of the installed latch with hidden lines shown.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

Structure

The major components of a ULT freezer cabinet are shown in FIG. 1. A vacuum insulated cabinet 10 is closed off by a vacuum insulated door 12 and has a door latch 14. A double (sometimes triple) gasket 16 is attached to the door 12 for sealing the interior of the cabinet against heat and moisture from the surrounding environment. A door latch embodying the invention has three main component parts with the third component part having several subcomponents.

Referring to FIG. 11, the first main component is a door axle 18 that, when installed on a ULT freezer, is attached to an edge of the door 12 for pivotally mounting a latch pivoting component to the door edge. The door axle 18 is preferably fixed to a flat plate attachment bracket 20 that is bolted, screwed or otherwise fixed to the door 12 and preferably extends horizontally from the door edge.

Referring to FIG. 12, the second main component is a striker 22 that, when installed on a ULT freezer, is attached to a sidewall of the cabinet 10 in a juxtaposition with the door axle 18 that permits the pivoting component to be rotated into and out of engagement with the striker 22. The striker 22 is preferably also fixed to an attachment bracket 24 which is attached to the sidewall of the cabinet 10 so that the striker preferably extends horizontally from the sidewall and parallel to the door axle 18. The preferred striker comprises a striker axle 26 which is fixed to its attachment bracket 24 and has a rotatable striker roller 28 journaled to the striker axle 26.

The third main component of the preferred embodiment of the invention is the latch pivoting component 30 illustrated in FIGS. 2-8. Some of those figures reveal a cam 36 and other structures formed as part of the pivoting component 30. FIGS. 5-8 are views showing the pivoting component 30 from its back which is not visible when the pivoting component 30 is installed in its operable orientation because the back lies nearly against the sidewall of the cabinet 10. However, in order to better illustrate the functional operation of the invention, FIGS. 9, 10, 13 and 14 illustrate the preferred embodiment from a different perspective. In FIGS. 9, 10, 13 and 14 the arrangement of the parts of the pivoting component 30 appear flipped like mirror images from the arrangement as viewed in FIGS. 2-8. That is because FIGS. 9, 10, 13 and 14 are views from outwardly beside the latch looking horizontally toward the latch when the latch is mounted in its operable position. In other words, FIGS. 9, 10, 13 and 14 are views looking through the subsequently described decorative outer surface 40 (FIG. 2) of the base 38 as if it were transparent to reveal the working structures from the perspective of a user looking at the side of the installed latch.

The latch pivoting component 30 is pivotable around the door axle 18 for opening and closing the door 12. The principal subcomponents of the latch pivoting component 30 are a base bearing 32, a handle 34 and a cam 36. These components are fixed together to operate as a unitary body. Preferably, the entire latch pivoting component 30 is cast as a unitary casting having its principal components all cast in attachment to a base 38. The casting is preferably machined to form a smooth surface on the cam 36 and bored through a boss to form the base bearing 32. The base 38 is essentially a plate that extends to the periphery of the latch pivoting component 30, has a planar interior surface and has an aesthetically contoured and decorative outer surface 40. Preferably a conventional key lock mechanism 39 is mounted to the base 38 with a mating lock striker mounted to the door 12 for securing a closed door 12 to the cabinet 10. The cam 36 can be a raised railing, ridge or fence as is illustrated but alternatively could be a shoulder or a slot machined into a sufficiently thick base.

When mounted in its operable position to a ULT freezer, the base bearing 32 is journaled to the door axle 18 and has a pivot axis for rotation of the entire latch pivoting component 30 about the door axle 18. As can be seen from FIGS. 2 and 11, the pivoting component 30 is retained on the door axle 18 (FIG. 11) by a washer 29 that is fixed to the door axle 18 by a fastener 31 and seats (FIG. 2) against the bottom of a counterbore 37. The counterbore 37 is closed by a decorative cover 33 that is press fit into the counterbore 37.

The handle 34 is attached to the base bearing 32 by way of their common attachment to the base 38 and extends outward from the periphery of the base 38. In use, the handle 34 is grasped by the user for manually rotating the base bearing and the entire latch pivoting component 30 about the door axle 18. Preferably, in the operable orientation of the installed latch, the handle 34 extends close to vertically upward when the door is latched closed so that the user pulls the handle 34 horizontally directly away from the cabinet to rotate the pivoting component 30 approximately 90° in an opening direction to open the door. The user pushes the handle 34 horizontally toward the cabinet and rotates the latch pivoting component 30 in the opposite closing direction in order to close and latch the door in the closed position. As will be seen, the latch pivoting component 30 should be positioned so that the striker harbor mouth (described subsequently) opens toward the striker 22 when the handle 34 is rotated to the fully open position in which it extends horizontally away from the front of the door 12. That positioning assures that the user is able to pull the handle 34 horizontally away from the cabinet 10 to open the door 12 and to push the handle 34 toward the cabinet 10 to close the door 12. That direction of user motion is the most ergonomically natural motion for opening and closing the door 12 and also enables the user to most comfortably apply an opening or closing force to the door handle 34.

The most important and unique subcomponent of the latch pivoting component 30 is the cam 36 and its interaction with the striker 22. The cam 36 is attached to the base bearing 32 by way of their common attachment to the base 38 and is engageable with the striker 22. The cam 36 has a cam surface defining a striker harbor 42 with a peripherally outwardly opening mouth 44 for receiving the striker 22 into the striker harbor 42. The striker harbor 42 extends from its mouth 44 progressively closer to the base bearing 32 at an acute angle to a radial from the pivot axis of the base bearing 32. When the entire latch pivoting component 30 is rotated, the cam surface moves along the striker 22. On both opening and closing the door 12, rotation by the user varies the position along the cam surface that is contacted by the striker 22.

Figure 13:
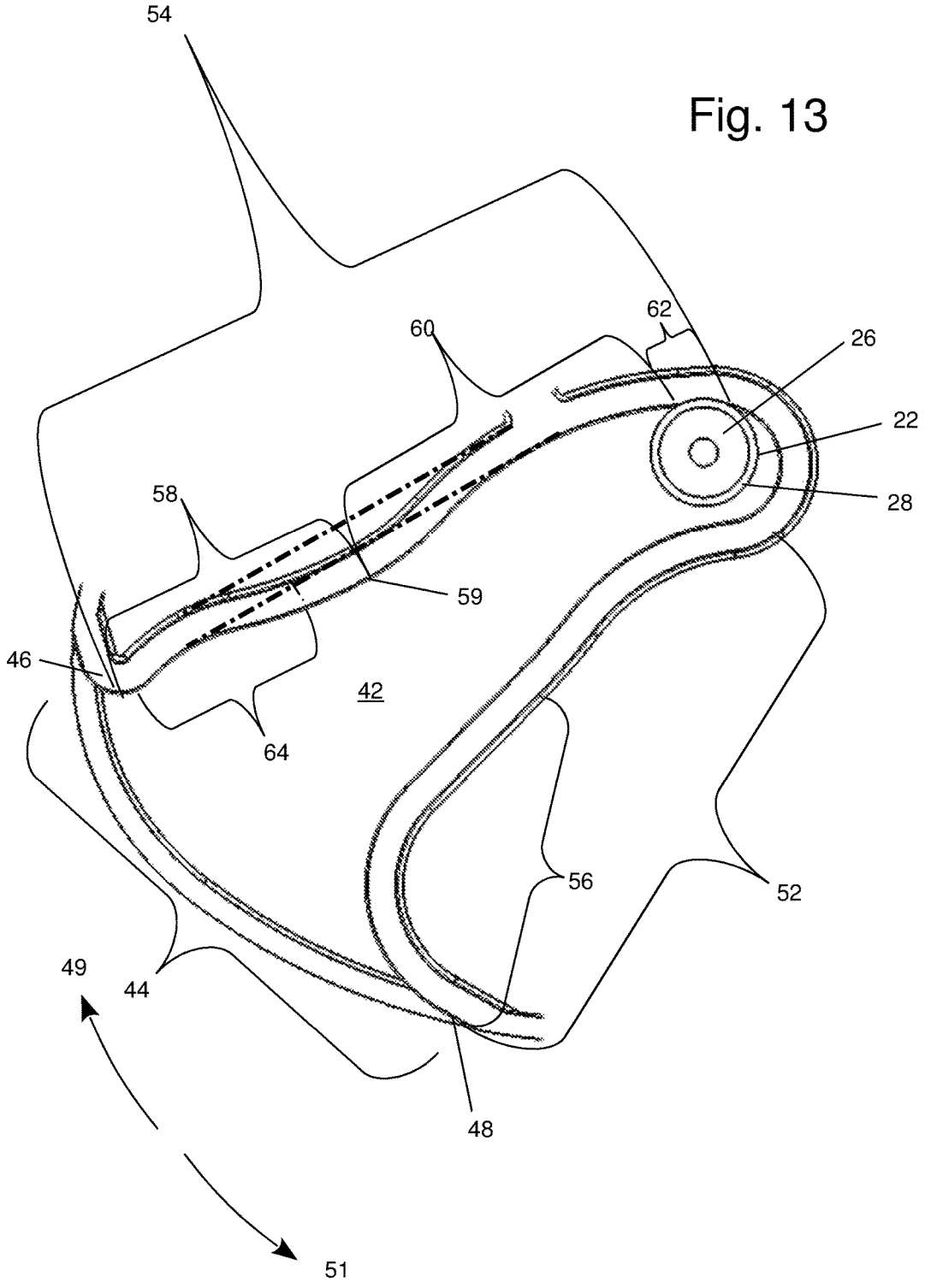
FIG. 13 is an enlarged front view of the cam and striker of the latch.

Referring to several figures but particularly to FIG. 13, the striker harbor 42 is a region between, and partially enclosed by, the surfaces of the cam 36. The cam surfaces lie along a path that is analogous to the shoreline of a harbor. The striker harbor 42 has a peripherally outwardly opening mouth 44 for receiving the striker 22 into the striker harbor 42 so that the surface of the cam 36 can apply a force against the striker 22 as the cam 36 is rotated about the pivot axis of the base bearing 32. The striker harbor 42 extends from the mouth 44 progressively closer to the base bearing 32. The term "progressively closer to the base bearing" means that, as the striker harbor 42 progresses away from the mouth 44, it progresses in a direction that becomes radially closer to the base bearing 32.

Preferably, as the cam surfaces that begin at the sides 46 and 48 of the mouth 44 progress away from the mouth 44, they both progress generally and principally in a direction that brings them radially closer to the base bearing 32 and they converge. However, as subsequently described, the cam 36 comprises a series of different cam segments and it is not necessary that all portions of all segments progress radially closer to the base bearing 32. As will be seen from a description of the operation of the latch, there can be discontinuities in the cam 36 because some parts of the cam 36 in the preferred embodiment are never contacted by the striker 22 and therefore could be absent. However, even though there may be segments of the cam 36 that are never contacted by the striker 22, it is preferred that the cam 36 extends smoothly and continuously to define the striker harbor 42 from one side 46 of the mouth 44, around the striker harbor 42 to the opposite side 48 of the mouth 44.

Additionally, for aesthetics, strength and simplicity and to provide a protective barrier against the infiltration of dust particles or other contamination from the ambient air, the cam 36 is preferably extended as an outer wall 50 extending continuously from one side 46 of the mouth 44 around the periphery of base 38 to the other side 48 of the mouth 44 in order to enclose the parts and protect them. This extension of the cam 36 never engages the striker 22 and does not function as a cam but only serves as a housing wall blended to join the cam 36.

An important feature of the invention is that the cam 36, and therefore its active cam surface, has two principal cam segments which are preferably subdivided into multiple cam segments. Each of the cam segment subdivisions varies in its functional operation. One principal cam segment is an opening cam segment 52 on one side of the striker harbor 42 and the other principal cam segment is a closing cam segment 54 on the opposite side of the striker harbor 42. The closing cam segment 54 is spaced radially farther from the base bearing 32 than the opening cam segment 52. The opening cam segment 52 is positioned a radial distance from the base bearing 32 to engage and slide along the striker 22 as the latch pivoting component 30 is rotated in an opening direction 49 of rotation. The closing cam segment 54 is positioned a radial distance from the base bearing 32 to engage and slide along the striker 22 as the latch pivoting component 30 is rotated in a closing direction 51 of rotation. However, it is not necessary that, in embodiments of the invention, the entire length of the cam 36 slides along in contact with the striker 22 during opening or closing rotations of the latch pivoting component 30.

Referring to FIG. 13, the opening cam segment 52 includes a push open cam segment 56 that is adjacent the harbor mouth 44 of the striker harbor 42 and extends along the side of the harbor 42 away from the mouth 44. The push open cam segment 56 is positioned to engage and slide along the striker 22 as the latch pivoting component 30 is rotated in an opening direction 49 of rotation. The push open cam segment 56 is constructed so it progresses radially closer to the pivot axis of the base bearing 32 as it progresses away from the mouth 44 of the striker harbor 42. As will be seen from the subsequent description of the operation of the preferred embodiment, the distance that the push open cam segment 56 extends inward along the opening cam segment 52 and away from the harbor mouth 44 can vary depending upon the dimensions of a particular design, including the width of the striker harbor 42 and the thickness of the gasket 16. In the normal operation of the preferred embodiment, the striker 22 only contacts the illustrated push open cam segment 56. Consequently, although not preferred, the remainder of the opening cam segment 52 that lies inward beyond the push open cam segment 56 can be eliminated. Preferably, the push open cam segment 56 at the side 48 of the striker harbor mouth 44 is gradually arcuately blended to the protective peripheral outer wall 50.

The closing cam segment 54 includes a rapid closing segment 58 adjacent the mouth 44 of the striker harbor 42 and a slow closing cam segment 60 spaced inward from the mouth 44 of the striker harbor 42 and radially nearer the pivot axis of the base bearing 32 than the rapid closing segment 58. The rapid closing segment 58 is constructed so its contact point with the striker 22 progresses toward the pivot axis of the base bearing 32 at a higher rate per degree of rotation of the pivoting component 30 than the slow closing segment 60. The significance of that is described in the description of the operation.

The initial, most outward segment of the rapid closing cam segment 58 is formed to have a capture valley 64 at a peripherally outer end of the closing cam segment 54. The outer part of the capture valley 64 hooks around toward the harbor mouth 44 to form a valley that captures the striker 22 and draws the striker into the striker harbor 42 when the latch pivoting component 30 is rotated in the closing direction 51. The capture valley 64 includes a cam surface that curves in a manner that a tangent to the valley cam surface makes a progressively greater acute angle with a radial from the door axle 18 through the intersection of the tangent and the cam surface as the valley cam surface progresses outwardly away from the door axle. Consequently, that cam surface engages the striker and applies a force against the striker that has a force component radially inwardly toward the door axle 18. That inward force component draws the striker into the striker harbor 42.

The closing cam segment 54 also has a retaining cam segment 62 in the form of an indentation. The indentation of the retaining cam segment 62 is best observed in FIG. 10 which is greatly enlarged because of the shallow depth of the indentation, which is preferably 0.5 mm to 1.0 mm deep. The retaining cam segment 62 is positioned at the end portion of the closing cam segment 54 contiguous to the side of the slow closing cam segment 60. The indentation of the retaining cam segment 62 extends away from the pivot axis of the base bearing 32 to provide a valley that receives the striker 22 and resists rotation of the pivoting component 30 in an opening direction of rotation when the door is fully closed. Most preferred is a retaining cam segment 62 that is a segment of a cylindrical surface having substantially the same radius as the peripheral surface of the striker 22.

Preferably the closing cam segment 54 extends through an angular interval greater than 45° and most preferably it extends through an angular interval of substantially 90° as illustrated for the preferred embodiment. This angular interval takes full advantage of the ergonomic and intuitive rotation of the pivoting component 30 by 90° by distributing the action of the closing cam segment 54 over a broader angular range of rotation thereby allowing the mechanical advantage to be varied at a smaller rate of change per degree of rotation.

Operation

Figure 14:
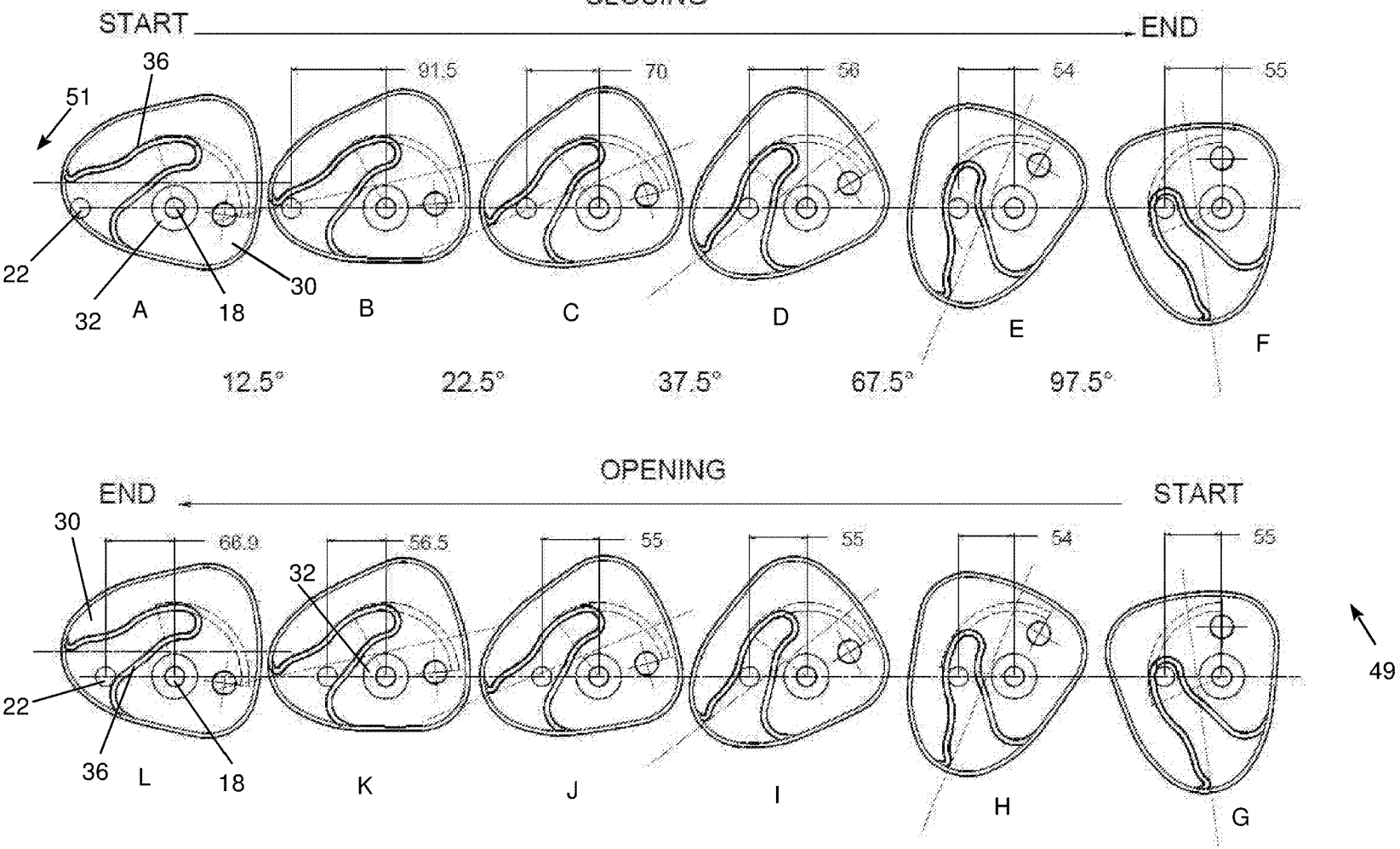
FIG. 14 is a diagrammatic view illustrating the operation of the latch in a series of positions during the opening and closing of the latch.

FIG. 14 shows the operational progression of the illustrated latch of the invention in degrees of rotation of the latch pivoting component 30 during closing and opening operations. The user pulls the handle 34 toward the user and downward to rotate the latch pivoting component 30 and open the door 12 of the ULT freezer cabinet 10. The operator raises and pushes on the handle 34 to rotate the latch pivoting component 30 and close the door 12.

The closing operation is illustrated along the upper row of symbolic images and starts at position A and ends at position F. The opening operation is illustrated along the lower row of symbolic images and starts at position G and ends at position L. The angle of rotation in degrees for each position is shown above each position. The opening and closing distance between the axis of the striker 22 and the pivot axis of the base bearing 32 is shown as a dimension in millimeters for representational rotational positions from the cam's first engagement against the striker 22 in position B through the position at which the cam 36 is about to disengage from the striker 22 in position L.

The operation of an embodiment of the invention is first described in a general overview and then described in increased detail.

On rotation in the closing direction 51, the closing cam segment 54 forces the door 12 and cabinet 10 toward each other as the cam 36 slides along the striker 22. This initially pushes the door 12 and gasket 16 toward the cabinet opening. When the gasket 16 contacts the side of the cabinet opening, further rotation compresses the gasket and tightens the door against the cabinet On rotation in the opening direction 49, the closing segment 54 first releases the compressed gasket 16 and allows it to elastically expand. During the release operation, the striker 22 travels back along the closing segment 54 of the cam 36 until gasket compression is released (the gasket stops elastically expanding). Further rotation of the handle 34 toward the user (away from the cabinet 10 pulling the door open) moves the opening segment 52 of the cam 36 against the striker 22. If the cabinet 10 is not adhered to the door 12 at the gasket 16 and the door 12 is not held closed by a pressure differential, the door 12 can be pulled open by the user. But if the door 12 is held closed by either, the application of a downward force by the user causes the opening segment 52 of the cam 36 to push against the striker 22 and push the striker 22 away from the door axle 18 to force apart the door 12 and the cabinet 10.

However, the operation is more complicated than simply explained above. The cam and the cam surface have important different cam segments each of which is designed to provide an optimum function for the state of the door position while the particular cam surface segment is in contact with the striker.

In order to describe the operation of the cam segments, it is desirable to describe some mechanical principles that are applied in the operation of the latch by these cam segments. The mechanical principles are based upon an analysis of the forces applied between the cam 36 and the striker 22 and how those forces affect both the mechanical advantage gained by the latch 14 at different rotational positions of the latch pivoting component 30 and how the rate of change of those forces as the handle 34 is rotated affects the rate at which the door 12 is moved closer or farther from the cabinet.

The first principle is the mechanical advantage gained from the latch 14 of the invention. Whenever the cam 36 engages the striker 22, the cam 36 applies a force against the striker 22 and the striker 22 applies an equal and opposite force against the cam 36. In the closing direction 51 of rotation, the striker 22 applies a force against the cam 36 which forces the door 12 toward a more closed position and eventually against the gasket 16 and finally compressing the gasket 16. Rotation in the closing direction causes the contact point of the striker 22 against the cam surface to move along the cam surface away from the mouth 44 of the striker harbor 42. At any point of contact, there is a mechanical advantage that multiplies the force applied to the hand grip 35 to a greater force applied by the striker 22 against the cam 36. The mechanical advantage is expressed as a ratio. The numerator of the ratio is the radius from the center of the door axle 18 to the hand grip 35 of the handle 34. The denominator of the ratio is the radius from the center of the door axle 18 to the point of contact of the cam 36 with the striker 22. So the mechanical advantage increases as the striker 22 point of contact against the cam 36 moves closer to the door axle 18 center thereby making the denominator of the mechanical advantage ratio smaller and the mechanical advantage greater. In other words, the mechanical advantage ratio becomes greater as the radius from the center of the door axle 18 to the point of contact of the cam surface with the striker 22 become less. This increases the mechanical advantage as the door 12 becomes closed further and tighter. An important feature of the present invention is that the same principles of mechanical advantage are also applied to opening the door 12.

The second principle is the change in the speed that the door 12 moves toward or away from the cabinet 10 as the latch 14 is rotated. The rate at which the door 12 is moved closer to or farther from the cabinet 10 is the rate at which the door axle 18 moves closer to or farther from the striker 22 per degree of handle rotation. That rate is a ratio. The numerator of that ratio is the distance [$\Delta D$] that the door 12 moves over an interval of movement of the striker 22 along the cam 36 as the handle 34 is rotated. That distance [$\Delta D$] is the amount of change of the radius from the pivot center of the door axle 18 to the point of contact of the striker 22 against the cam 36. The denominator of that ratio is the angle [$\Delta\alpha$] through which the handle 34 is rotated to cause the door to move by a distance [$\Delta D$]. However, because the cam 36 has a smoothly continuous curved cam surface, the rate at which the door 12 is moved closer or farther from the cabinet continuously changes as the cam 36 moves along the striker 22. Therefore, except for any cam surface that is linear, it is more mathematically accurate to designate the rate at which the door 12 is moved closer or farther from the cabinet 10 as the differential [dD]/[dα].

With these principles in mind, the operation of the different cam segments can be described. Each cam segment provides a mechanical advantage and a rate of door movement toward or away from the cabinet 10 that is most desirable for the state of the door 12 when a particular cam segment is engaged against the striker 22. The states of the door include: (1) the door 12 being fully latched closed with the striker 22 seated in the valley of the retaining cam segment 62 and the gasket 16 compressed; (2) the gasket 16 partially compressed; (3) the gasket 16 relaxed but seated against the cabinet 10 and possibly adhered to the cabinet 10; and (4) the gasket 16 freed from contact with the cabinet 10.

The operation is described in association mainly with FIGS. 13 and 14. The different cam segments are shown in the greatly enlarged FIG. 13 because the drawings in FIG. 14 are so small scale that there is insufficient space to show them.

Referring to FIG. 14, as the pivoting component 30 rotates counterclockwise in the closing direction 51, the closing segment 54 of the cam 36 eventually engages the striker 22 and pulls it towards the axis of the base bearing 32. The closing distance can be seen to diminish as the latching handle progresses from position B to position E. The final closed position is at F.

Looking at the closing operation in more detail, the striker 22 first engages the rapid closing cam segment 58 near the closing side 46 of the striker harbor mouth 44. The rapid closing cam segment 58 then slides along the striker 22 to the end of the rapid closing cam segment 58 which ends at the peak 59 of a hump in the cam 22. Because of the curvature of the cam segment 58 as it approaches the peak 59, the surface of the cam segment 58 pushes the striker 22 more rapidly toward the base bearing 32 than does any other part of the cam 36. That causes the rate of increase of the mechanical advantage and the rate of movement of the door 12 toward the cabinet 10 to be relatively large. That is appropriate because while the rapid closing cam segment 58 is engaged against the striker 22, the gasket 16 of the door 12 has not yet engaged the cabinet 10 so the door 12 should be closed more rapidly and is easier to close because no force is yet applied for compressing the gasket 16.

Further rotation of the latch pivoting component 30 in the closing direction causes the striker 22 to slide across the slow closing cam segment 60 beginning at the peak 59 of the hump and continuing to the edge of the retaining cam segment 62. Although the slow closing cam segment 60 continues to progress closer to the base bearing 32, it does so at a lower rate per degree of rotation. Consequently, the mechanical advantage is near its maximum but is increased at a smaller rate per degree of rotation. That is appropriate because the state of the door 12 during engagement of the striker 22 with the slow closing cam segment 60 is that the gasket 16 is being compressed. Consequently, the rotation of the latch pivoting component 30 is distributed over a greater arc of rotation thereby requiring the application of less force by the user per degree of rotation. This is analogous to walking up a hill along a less steep but longer path.

Finally, the user rotates the latch pivoting component 30 in the closing direction 51 until the striker 22 falls into the valley of the retaining cam segment 62. As seen at position F, the spring-like force applied by the gasket 16 pushes the door 12 a slight distance in the opening direction so that the cam 36 is prevented from rotating in an opening direction except upon application by a user of a sufficient force in the opening direction of rotation. This is appropriate because the state of the door 12 is closed and the retaining cam segment 62 prevents rotation in the opening direction from vibration.

As an alternative, the hump in the cam 36 that extends over adjoining parts of the rapid closing cam segment 58 and the slow closing cam segment 60 can be eliminated. Instead a linear segment of the cam can be substituted for the hump as illustrated by the phantom lines in FIG. 13. With this alternative, the cam segments 58 and 60 continue to progress closer to the base bearing 32 but a linear progression is substituted for progression over a hump.

Referring to FIG. 14, the opening operation starts at position G and ends at position L. In this case, as the latch pivoting component 30 with its base 38 rotates clockwise, the striker 22 eventually comes into contact with the push open cam segment 56 at position K. At that point, further rotation of the pivoting component 30 forces the door 12 away from striker 22 with a mechanical advantage according to the above-described principles. Consequently, the user is advantageously able to apply a force in a direction to open the door 12 with the benefit of the mechanical advantage. That is particularly helpful if the door 12 is resisting opening for the reasons explained above. From the initial contact of the opening cam segment 52 at position K against the striker 22, the push open cam segment 56 slides along the striker 22 around the arcuate opening side 48 of the harbor mouth 44. As the striker 22 slides along the push open cam segment 56, the mechanical advantage is reduced but the rate at which the door 12 opens increases. That is appropriate because once the resistance to the door 12 opening is overcome and the gasket 16 releases from the cabinet 10, the door 12 is moved more quickly open by the user. Of course when the striker harbor mouth 44 is at position L, the door 12 can continue to be opened by the user pulling the handle 34 horizontally away from the cabinet 10 without any further operation of the latch 14 of the invention.

From all of the above description, it can be appreciated that the invention involves a latch with an integral latching mechanism. The latching mechanism is based on an over center design. A cam track built into the latch that is mounted on the door engages a striker that functions similarly to a cam follower that is mounted onto the cabinet. The engagement of the striker with the cam occurs before the limit of gasket compression so that the mechanical advantage of the mechanism becomes available to the user immediately on engagement of the latch, well before the latch is fully seated. When the door is open, the latch is in a position of approximately 90° in rotation from its locked position. The latch is thus easily gripped with one hand. As the door is closed, the handle is rotated upward and, by engaging the cam 36 against the striker 22, draws the door 12 towards the cabinet 10 while compressing the gasket 16. As the handle approaches the gasket seating position, the cam action applies an over center force to the striker 22 to provide a positive final resting place for the latch 14. The special attribute of this invention is that a mechanical advantage of this type of mechanism is also applied to opening the freezer. Normally the freezer door can be opened by simply removing the latching force when the handle is rotated to the opening position. In this invention, when the handle is rotated to the open position, the striker will move to the opposite cam track in the latch and that cam track will apply an opening force to the striker that is highly leveraged to the advantage of the user. That means that small handle forces will be amplified as an opening force to the door and, in this way, break any bonding force due to ice and any pressure differential force that may be holding the door shut closed.

REFERENCE NUMBER—PARTS LIST

10 cabinet
12 door of cabinet
14 latch
16 gasket
18 door axle
20 attachment bracket for door axle
22 striker
24 attachment bracket for striker
26 striker axle
28 striker roller
29 base bearing retention washer
30 latch pivoting component
31 fastener to secure washer 29
32 base bearing
33 decorative cover
34 handle
35 hand grip of handle
36 cam
37 base bearing counterbore
38 base (plate)
39 key lock mechanism
40 outer surface of base (of pivoting component)
42 striker harbor
44 harbor mouth
46 closing side of harbor mouth
48 opening side of harbor mouth
49 opening direction of rotation
50 outer wall
51 closing direction of rotation
52 opening cam segment/surface
54 closing cam segment/surface
56 push open cam segment/surface
58 rapid closing cam segment/surface
59 peak of cam hump
60 slow closing cam segment/surface
62 retaining cam segment/surface
64 striker capture valley This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A door latch for securing a door against a cabinet and for assisting the opening of the door, the door latch comprising:

(a) a latch pivoting component pivotally attached to a door axle, the door axle attachable to an edge of the door;

(b) a striker attachable to the cabinet in a juxtaposition with the door axle that permits the latch pivoting component to be rotated into and out of engagement with the striker; and (c) said latch pivoting component having structures fixedly attached together to form a single unit for fixed angular rotation together, said structures including:

(i) a base bearing journaled to the door axle and having a pivot axis;

(ii) a handle attached to the base bearing for manually rotating the base bearing about the door axle; and (iii) a cam attached to the base bearing and engageable with the striker by rotation of the base bearing, the cam having a cam surface defining a striker harbor with a peripherally outwardly opening mouth for receiving the striker into the striker harbor, the striker harbor extending from the mouth progressively closer to the base bearing;

wherein, by rotation of the latch pivoting component, the door latch acts as a lever to apply a force with a mechanical advantage for assisting in both the opening and the closing of the door.

2. A door latch in accordance with claim 1 wherein the cam surface includes a closing cam surface on a side of the striker harbor and an opening cam surface on the opposite side of the striker harbor, the closing cam surface being spaced radially farther from the base bearing pivot axis than the opening cam surface, the opening cam surface positioned a radial distance from the base bearing to engage and slide along the striker as the latch pivoting component is rotated in an opening direction of rotation and the closing cam surface positioned a radial distance from the base bearing to engage and slide along the striker as the latch pivoting component is rotated in a closing direction of rotation.

3. A door latch in accordance with claim 2 wherein the opening cam surface includes a push open cam segment adjacent the mouth of the striker harbor and positioned to engage and slide along the striker as the latch pivoting component is rotated in an opening direction of rotation, the push open cam segment progressing radially closer to the pivot axis as the push open cam segment progresses away from the mouth of the striker harbor.

4. A door latch in accordance with claim 3 wherein the closing cam surface includes a capture valley formed at a peripherally outer end of the closing cam surface, the capture valley having a valley cam surface that curves in a manner that a tangent to the valley cam surface makes a progressively greater acute angle with a radial from the door axle as the valley cam surface progresses outwardly away from the door axle.

5. A door latch in accordance with claim 4 wherein the closing cam surface includes a rapid closing segment adjacent the mouth of the striker harbor and a slow closing cam segment spaced from the mouth of the striker harbor and radially nearer the pivot axis than the rapid closing segment, the rapid closing segment progressing toward the pivot axis at a higher rate per degree of rotation of the pivoting component than the slow closing segment.

6. A door latch in accordance with claim 5 wherein the closing cam segment further comprises a retaining cam segment positioned on the side of the slow closing cam segment that is opposite from the fast closing segment, the retaining cam segment comprising an indentation extending away from the pivot axis to provide a valley that receives the striker and resists rotation of the pivoting component in an opening direction.

7. A door latch in accordance with claim 6 wherein the door latch includes a base to which the handle, the base bearing and the cam are all connected and move in common rotational motion around the bearing pivot axis.

8. A door latch in accordance with claim 7 wherein the closing cam segment extends through an angular interval of rotation of the latch pivoting component greater than 45°.

9. A door latch in accordance with claim 8 wherein the closing cam segment extends through an angular interval of rotation of the latch pivoting component of substantially 90°.

10. A door latch in accordance with claim 9 wherein the cam is extended from one side of the striker harbor mouth around the periphery of base to the other side of the striker harbor mouth to form a protective peripheral wall.

11. A door latch in accordance with claim 10 wherein the push open segment of the cam is arcuately blended to the protective peripheral wall.

* * * * *